US005088211A

United States Patent [19]

Walkhoff

[11] Patent Number: 5,088,211

[45] Date of Patent: Feb. 18, 1992

[54] SKI BOOT

[75] Inventor: Klaus Walkhoff, Kreuzlingen, Switzerland

[73] Assignee: Raichle Sportschuh AG, Kreuzlingen, Switzerland

[21] Appl. No.: 427,495

[22] Filed: Oct. 27, 1989

[30] Foreign Application Priority Data

Nov. 21, 1988 [CH] Switzerland ..... 4308/88'

[51] Int. Cl.[5] ..... A43B 5/04

[52] U.S. Cl. ..... 36/117; 36/119; 36/120

[58] Field of Search ..... 36/117, 118, 119, 120, 36/121

[56] References Cited

U.S. PATENT DOCUMENTS

| | | | |
|---|---|---|---|
| 4,095,356 | 6/1978 | Robran et al. | 36/121 |
| 4,574,500 | 3/1986 | Aldinio et al. | 36/117 X |
| 4,644,671 | 2/1987 | Walkhoff | 36/119 |
| 4,685,226 | 8/1987 | Olivieri et al. | 36/120 |
| 4,739,563 | 4/1988 | Guggenberger | 36/119 X |
| 4,864,744 | 9/1989 | Walkhoff | 36/121 X |
| 4,910,888 | 3/1990 | Perrissoud | 36/117 |

FOREIGN PATENT DOCUMENTS

| | | | |
|---|---|---|---|
| 53340 | 11/1981 | European Pat. Off. | 36/117 |
| 132706 | 2/1985 | European Pat. Off. . | |
| 231467 | 8/1987 | European Pat. Off. . | |
| 2404447 | 8/1974 | Fed. Rep. of Germany | 36/121 |
| 2807348 | 8/1979 | Fed. Rep. of Germany . | |
| 3600436 | 7/1987 | Fed. Rep. of Germany . | |
| 3628912 | 3/1988 | Fed. Rep. of Germany . | |
| 2063622 | 7/1971 | France . | |
| 529524 | 1/1963 | Switzerland . | |

*Primary Examiner*—Stuart S. Levy
*Assistant Examiner*—Joseph A. Rhoa
*Attorney, Agent, or Firm*—Oliff & Berridge

[57] ABSTRACT

In the heel area of a ski boot a rubber torsion spring element is arranged, the core piece of which is anchored in a rotationally fixed manner on the lower shell of the ski boot by means of a bracket. An outer tubular piece, which surrounds the core piece coaxially, is connected to a tension member which engages with its end at the rear on a rear shaft part of the boot shell. The rear shaft part and a front shaft part are pivotable relative to the lower shell about an articulation axis into a forward lean position. The spring element damps the forward lean movement and, by means of the use of snappy rubber compounds, is extensively independent of the ambient temperature. Additionally, it allows the adjustment at least of the starting point of the spring or damping effect by means of a knurled nut.

22 Claims, 7 Drawing Sheets

Fig. 9
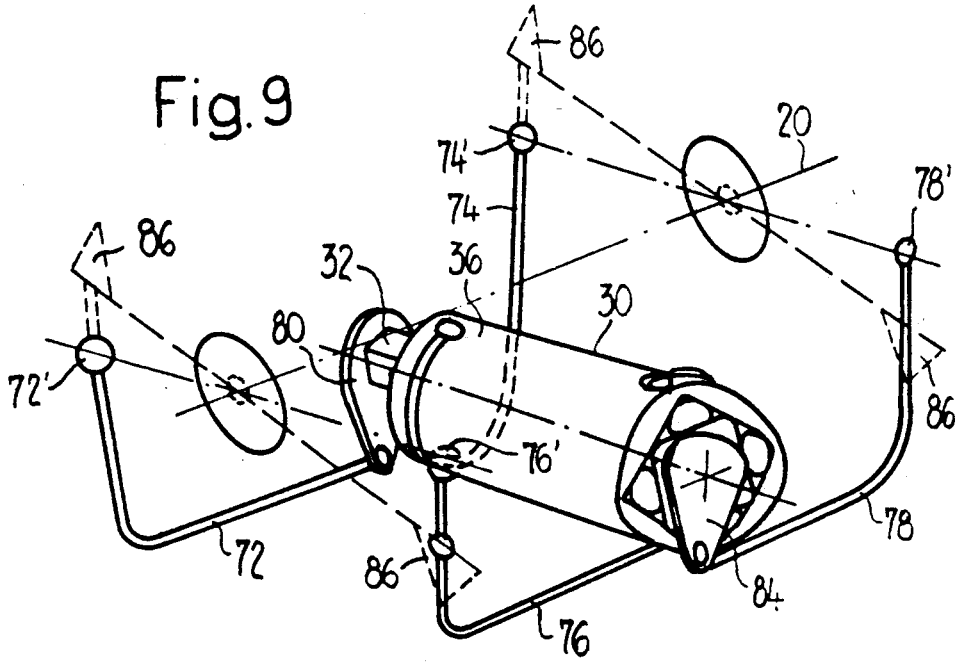
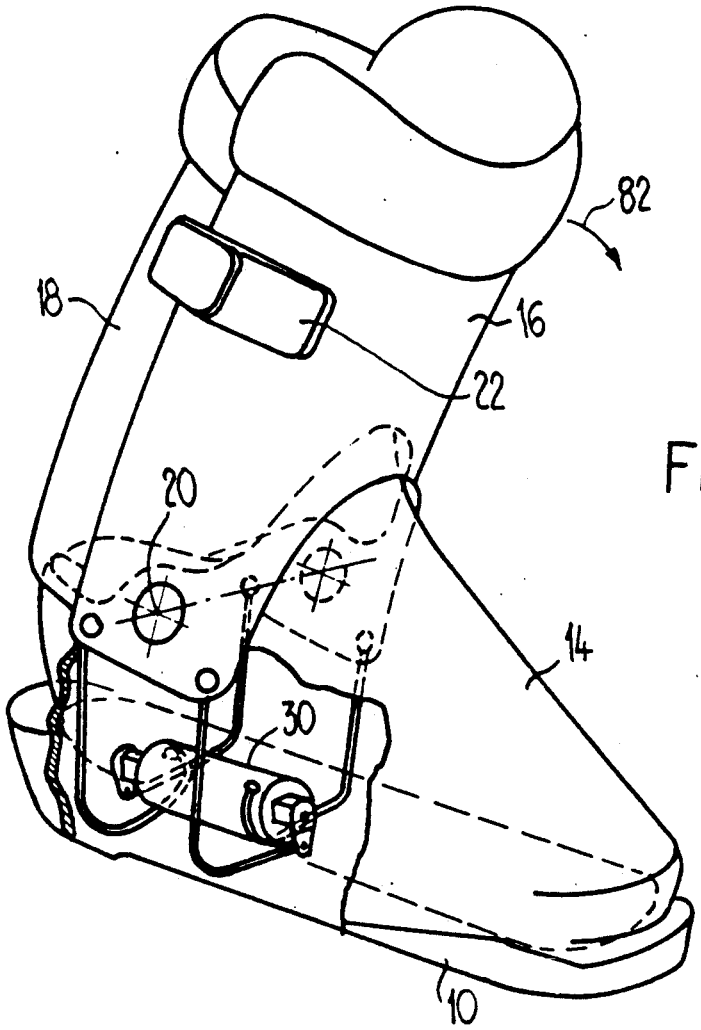
Fig. 8

SKI BOOT

BACKGROUND OF THE INVENTION

1. Field of the Invention

The invention relates to a ski boot comprising a boot shell having a boot sole and which is formed by a lower shell and a boot shaft, the boot shaft being movable relative to the lower shell at least in the forward lean direction.

2. Description of the Related Art

From CH-PS 529 524, a ski boot is known, which has a lower shell and a shaft part which in the forward lean direction is movable in relation to the lower shell. The shaft part is connected to the lower shell in two places, which are situated in opposite positions in relation to the central plane of the boot, by means of elastomeric discs. These discs form the only connection between the lower shell and the shaft part. By selecting discs with different properties, different damping effects can be achieved. After the assembly of lower shell and shaft part, however, it is no longer possible to modify the damping properties without further action. By virtue of the discs being arranged at the articulation points of the shaft part on the lower shell, the freedom to develop the ski boot structurally is limited. Additionally, the discs are accessible from the outside and thus exposed to environmental influences.

SUMMARY OF THE INVENTION

The object of the present invention is thus to produce a ski boot of the type mentioned in the introduction, the damping arrangement of which is of simple construction and extensively independent of temperature influences and can develop a damping effect which corresponds to the respective requirements over a longer period of time also.

According to the invention, the object is achieved by the features of a damping arrangement, having at least one rubber spring element, which is effective to resiliently dampen the forward lean movement between the lower shell and the shaft. The rubber spring element has, arranged between a core piece and a tubular piece which surrounds the core coaxially, members consisting of an elastomeric material to permit a limited relative rotation between the core piece and the tubular piece.

By means of the special formation of the rubber spring element, not only a progressive spring characteristic but also a limiting of the spring excursion by the spring element itself is achieved. This has the special advantage that a hard and unpleasant stop to special advantage that a hard and unpleasant stop to limit the spring excursion is not necessary. The damping effect is created by means of a rotation and flexing movement of the elastomeric members upon a relative rotation between core piece and tubular piece. For the rubber elements, materials can be used which have already proved reliable for similar uses, preferably materials based on natural rubber or synthetic elastomers. In particular by means of the use of snappy rubber compounds, such a spring element is not subject to any significant temperature influences within the field of use, so that a constant spring effect is to be expected.

In an embodiment according to claim 2, the rubber spring element forms an elastic connection between the boot sole or the lower shell and the force transmission member, which in turn engages on the shaft. A rotationally fixed connection to the boot sole or lower shell relates only to the spring effect of the spring element, but not to its possibility for adjustment in order to achieve a basic position.

In a preferred embodiment according to claim 3, the rubber spring element is accommodated in a particularly protected location, so that a risk of accident or damage is completely excluded, in particular when the spring element is accommodated completely within the heel. Additionally, with such an accommodation, the risk of dirtying is also relatively low. In the embodiment according to claim 5, the spring characteristic can be adjusted, so that a ski boot equipped with such an element can be adapted to the abilities of the skier.

An especially preferred embodiment is produced according to claim 6, by means of which embodiment the spring characteristic can be adjusted by the skier himself with simple and easily accessible means. In spite of this individual possibility for adjustment of the flexing effect by changing the prestress, there is no limitation of the angle of rotation and thus of the spring excursion.

By means of a preferred embodiment according to claim 7, that position of the shaft relative to the boot sole or to the lower shell can be selected in which the spring effect is equal to zero. Starting from this "zero position", a spring effect is possible in both the forward lean and backward lean direction and is dependent on the arrangement of the force transmission member.

In an embodiment according to claim 8, the spring effect is limited to a movement in the forward lean direction.

Claim 9 describes a preferred embodiment for adjusting the rest position or the starting point of the spring effect in connection with claim 8. The nut which is used for the adjustment can be a knurled nut, for example, so that the adjustment can be carried out at the rear on the shaft at any time and without tools by the skier himself.

Claim 10 describes a possibility for adjusting the rest position or the starting point of the spring effect, when the force transmission member engages on the shaft without any possibility for adjustment. In the embodiment according to claim 10, the adjustment is generally carried out by means of a tool, so that such an embodiment is advantageous if an inadvertent readjustment is to be avoided.

In an embodiment according to claim 11, the spring effect is limited to a movement in the forward lean direction, although the rear shaft part can be swung up, without stress on the spring element, for insertion of the foot.

In an embodiment according to claim 14, there is a rigid connection in both directions between the spring element and the shaft, so that the spring effect of the spring element is stressed in both the forward lean and backward lean direction.

In an embodiment according to claim 13, similarly to that according to claim 12, there is a spring effect on the shaft in both directions but, by means of the different geometry of the force transmission elements, a different distribution of the spring characteristic on the pivoting angle of the shaft is brought about.

Claim 14 describes an embodiment, in which additionally a double-sided effect of the spring element is transmitted to the shaft by means of cables or chains.

In an embodiment according to claim 15, the spring effect is only transmitted in the forward lean directions, while in an embodiment according to claim 16 the spring effect is transmitted in both the forward lean and backward lean direction. For the specialist it is clear that the cables, starting from the spring element, must first run parallel to the sole surface, in order that they can then be guided, via deflection elements, along the inner wall to the points of engagement on the shaft.

In an embodiment according to claim 17, two spring elements interlock. These can be arranged in terms of their effect either in parallel according to claim 18 or serially according to claim 19. By means of these possibilities, the specialist is afforded the opportunity of selecting the arrangement depending upon the desired spring effect.

An arrangement according to claim 20 is particularly advantageous when a low construction height is to be achieved.

Claim 21 demonstrates a possibility for supplementing the characteristic of a spring element.

BRIEF DESCRIPTION OF THE DRAWINGS

Exemplary embodiments of the invention are described more closely below with reference to the drawings in which:

FIG. 8 shows a further alternative embodiment with an over-mounted spring element;

FIG. 9 shows the arrangement of the spring element according to FIG. 8;

DESCRIPTION OF THE PREFERRED EMBODIMENTS

Figure 1:
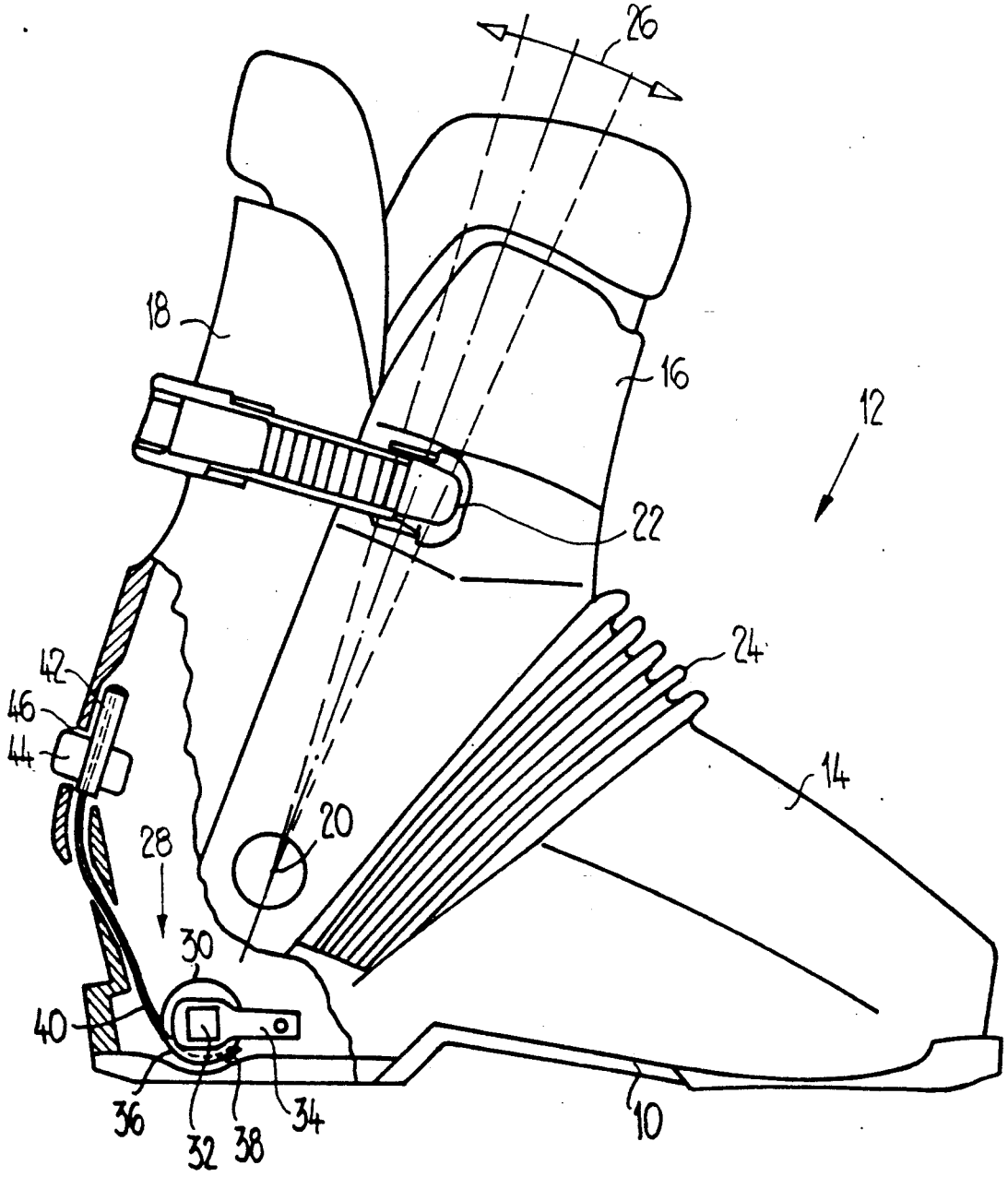
FIG. 1 shows a ski boot with a cut-away representation of the boot shell in the heel area in order to make visible a rigidly anchored torsion spring element and a tension member which engages on the rear shaft part.

The ski boot represented in FIG. 1 has a boot sole 10 with a boot shell 12 arranged thereon, which consists of a lower shell 14, which is rigidly connected to the boot sole 10, and a shaft which consists of a front shaft part 16 and a rear shaft part 18. The two shaft parts 16 and 18 are articulated on the lower shell 14 at the articulation axis 20, which lies horizontally and transversely to the longitudinal axis of the boot, and held together in the upper area by means of a clasp 22. Between the lower shell 14 and the front shaft part 16 compressible ribs 24 are arranged. A double-headed arrow 26 indicates the movability of the two shaft parts 16 and 18 in relation to the boot sole 10. The lower shell 14 and the shaft parts 16 and 18 are represented in a cut-away manner in the heel area in order to make visible a damping arrangement 28 which is situated in this area. The damping arrangement 28 has a torsion rubber spring element 30, the core piece 32 of which is rigidly connected to the lower shell 14 by means of a rotation protection bracket 34. The spring element 30 also has a tubular piece 36, which is rotatable in relation to the core piece and on the circumference of which a tension member 40 is fastened by means of a screw 38. At its other end the tension member 40 is connected to a threaded bolt 42 which engages on the rear shaft part 18 by means of a knurled nut 44. The knurled nut 44 is held in the rear shaft part 18 by means which are not shown and is accessible from the outside through a window 46.

The shaft, which consists of the parts 16 and 18 and is pivotable in relation to the boot sole 10 by means of the articulation axis 20 and the transverse ribs 24, allows the skier wearing the boot a forward lean position in which the leg assumes a position which is inclined forwards in relation to the foot. The damping arrangement 28 serves in this connection on the one hand to damp the forward lean movement and on the other to return the shaft resiliently into a rest or starting position. In the event of a forward lean movement, the tension member 40 is tautened in order to at the same time unwind partially from the tubular piece 36. As spring elements (not shown in FIG. 1) are arranged between the core piece 32, which is anchored in a rotationally fixed manner on the lower shell 14, and the tubular piece 36, which surrounds the core piece 32 coaxially, a spring force acting upon the tension member 40 and thus on the rear shaft part 18 is produced.

Figure 2:
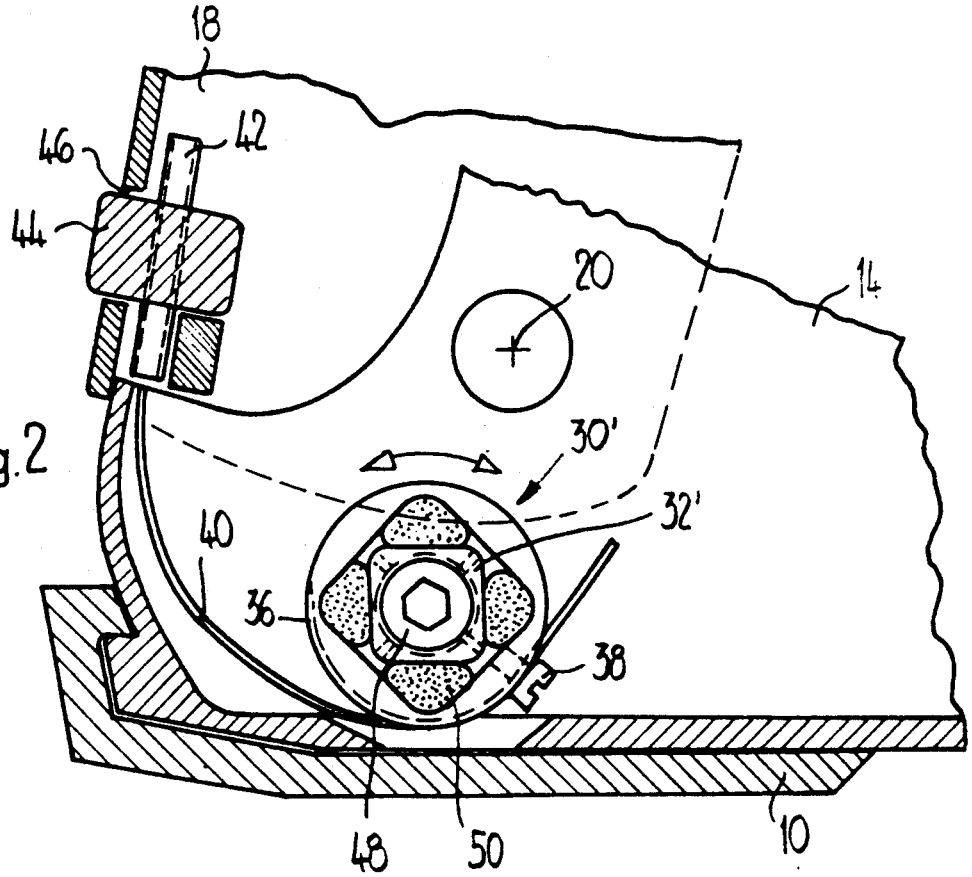
FIG. 2 shows a detail of the heel area according to FIG. 1 on an enlarged scale and in longitudinal section through the centre.

FIG. 2 shows on an enlarged scale in principle a similar damping arrangement to that in FIG. 1, with the development, however, that the spring effect of the rubber torsion spring element 30' is adjustable. To this end, the core piece 32' is formed as a slotted expanding member which, when a hexagon socket screw 48 is screwed in, is expanded in order to increase the prestress on members 50, which are arranged between the core piece 32' and the tubular piece 36 and consist of an elastomeric material.

FIG. 2 also shows that the core piece 32, on its outer side and the tubular piece 36 on its inner side have a square shape. The members 50, which are mounted between these two parts and consist of an elastomeric material, give the rubber spring element 30 or 30' the effect of a torsion spring, as they make possible limited rotation relative to one another of the two square-shaped parts 32 or 32' and 36. Generally the members 50 are manufactured as rubber members based on natural rubber. As such rubber is not compressible, the angle of rotation of such a spring element is generally limited to approximately $\pm 30°$. In the event of stressing as a torsion spring, the rubber members are subject to a rotation/flexing movement. For application in ski boots, rubber members in particular have the advantage that their spring characteristic is within wide limits hardly influenced by the ambient temperature. Instead of rubber, of course, the use of plastic which is similar to rubber is also possible, provided that it is also not very temperature-dependent in the field of use.

Figure 3:
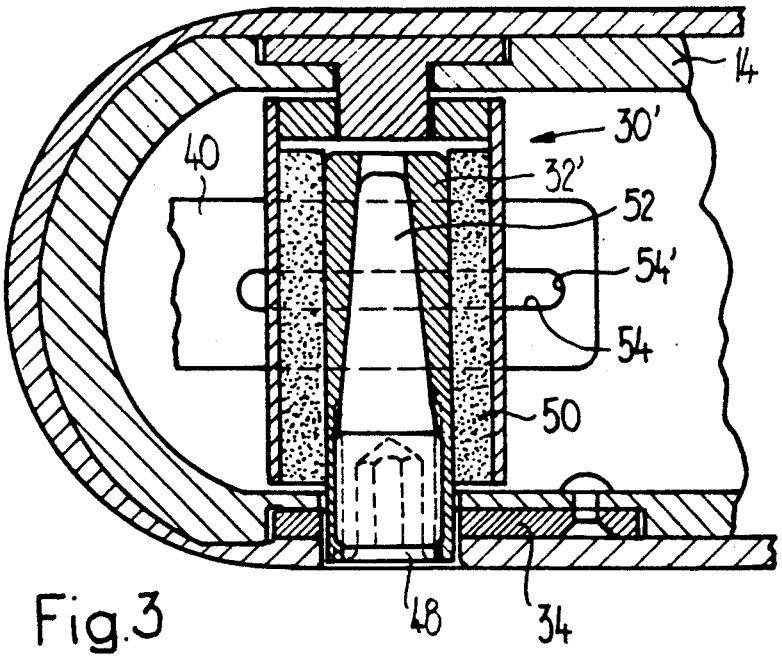
FIG. 3 shows a view from above of a horizontal section according to FIG. 2.

It can be seen from FIG. 3 that the hexagon socket screw 48 has a conical projection 52, in order to expand the core piece 32' which is formed as a slotted expanding member.

It can also be seen from FIG. 3 that the tension member 40 has an oblong hole 54, which extends in the longitudinal direction, for its fastening by means of the screw 38 to the tubular piece 36 (FIG. 2). The screw 38 has an unthreaded projection adjoining its head in order to make possible a displacement in the longitudinal direction of the tension member 40 when in the tautened state. This displacement is necessary in order to be able to pivot the rear shaft part 18 backwards for opening, and inserting the foot. With the shaft part 18 closed, the oblong hole 54 lies with its end 54' bearing against the shaft of the screw 38. The screw 38 thus serves not only as a direct fastening of the tension member 40 but also as a stop screw.

Figure 4:
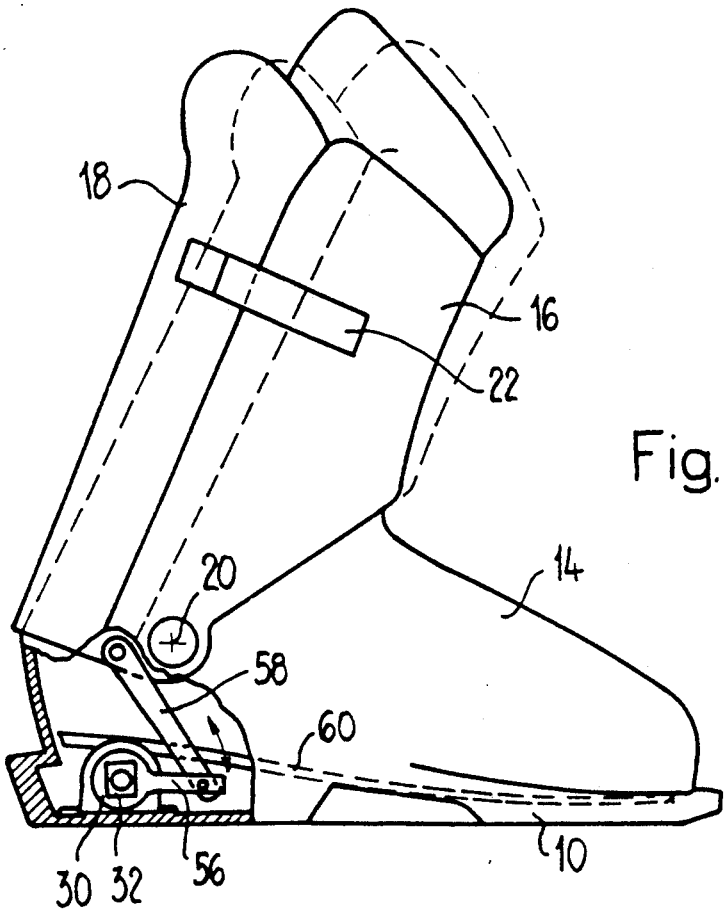
FIG. 4 shows an alternative embodiment to FIG. 1 with lever and connecting rod.

FIG. 4 shows an embodiment in which, instead of a tension member, a lever 56 is arranged on the spring element 30 as force transmission member, which lever engages in an articulated manner via a connecting rod 58 either on the front shaft part 16 or the rear shaft part 18. It is also possible that the connecting rod 58 is connected to both shaft parts 16 and 18. The connecting rod 58 can be arranged internally or externally on the boot. It can also be seen from FIG. 4 that the spring element 30 is installed in the heel area below the insole 60.

In an embodiment according to FIG. 4 it is possible to arrange the lever 56 either on the core piece 32 or on the tubular piece 36 and to anchor the other end in each case of the spring element 30 in a rotationally fixed manner either on the lower shell or on the boot sole 10.

Figure 5:
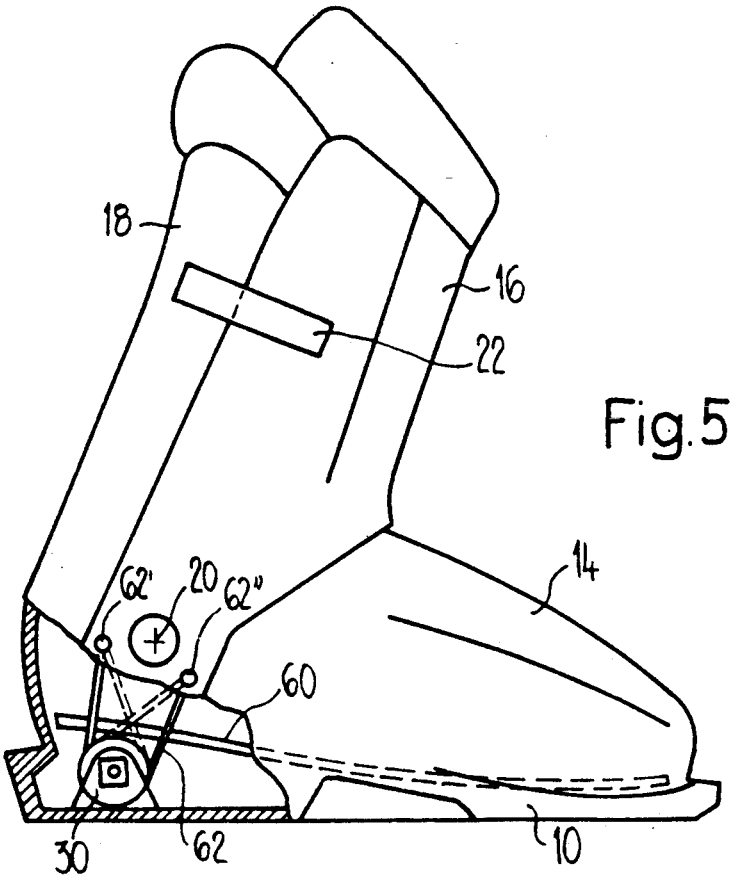
FIG. 5 shows a further alternative embodiment with tension cables.

FIG. 5 shows an embodiment in which the force transmission member is formed by cables or chains 62, which wind round the spring element 30 and engage with their two ends 62' and 62" on the front shaft part 16. One engagement point 62' lies behind and the other 62" in front of the articulation axis 20.

Figure 6:
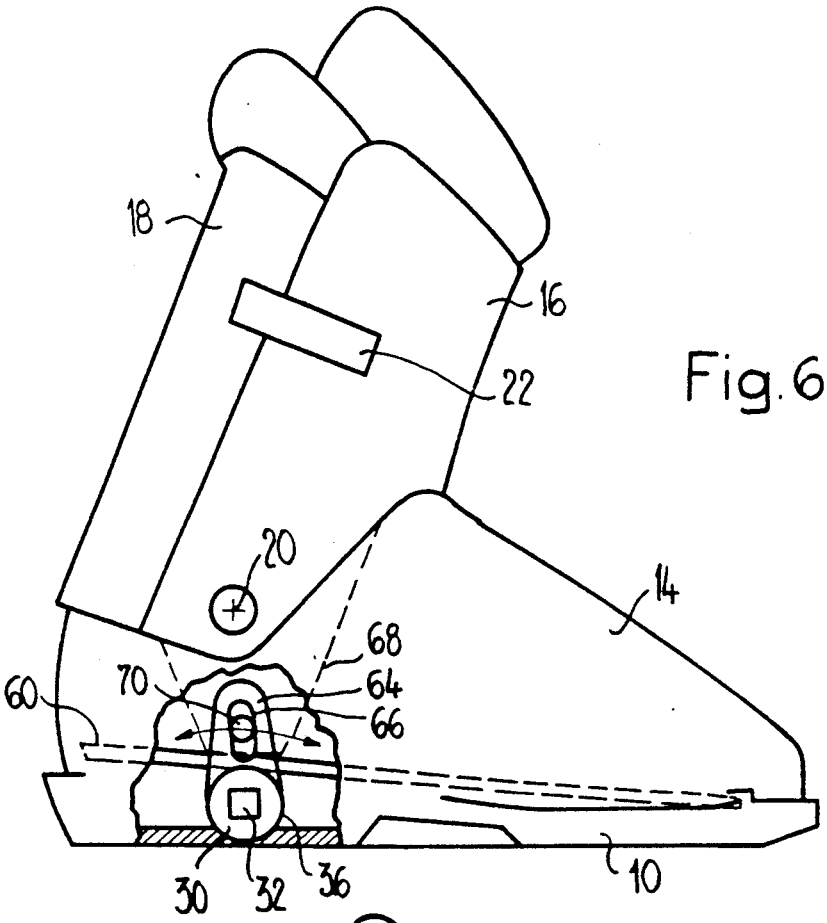
FIG. 6 shows a further alternative embodiment with lever and carrier.

In an embodiment according to FIG. 6, a lever 64 is arranged on the spring element 30 as force transmission member, which lever, by means of an oblong hole 66 which extends in the longitudinal direction in the lever 64, engages on a carrier pin 70 which is connected to an extension 68 of the front shaft part 16. In this embodiment the lever 64 is connected to the core piece 32, while the tubular piece 36 of the spring element 30 is anchored in a rotationally fixed manner on the lower shell 14 or the boot sole 10.

Figure 7:
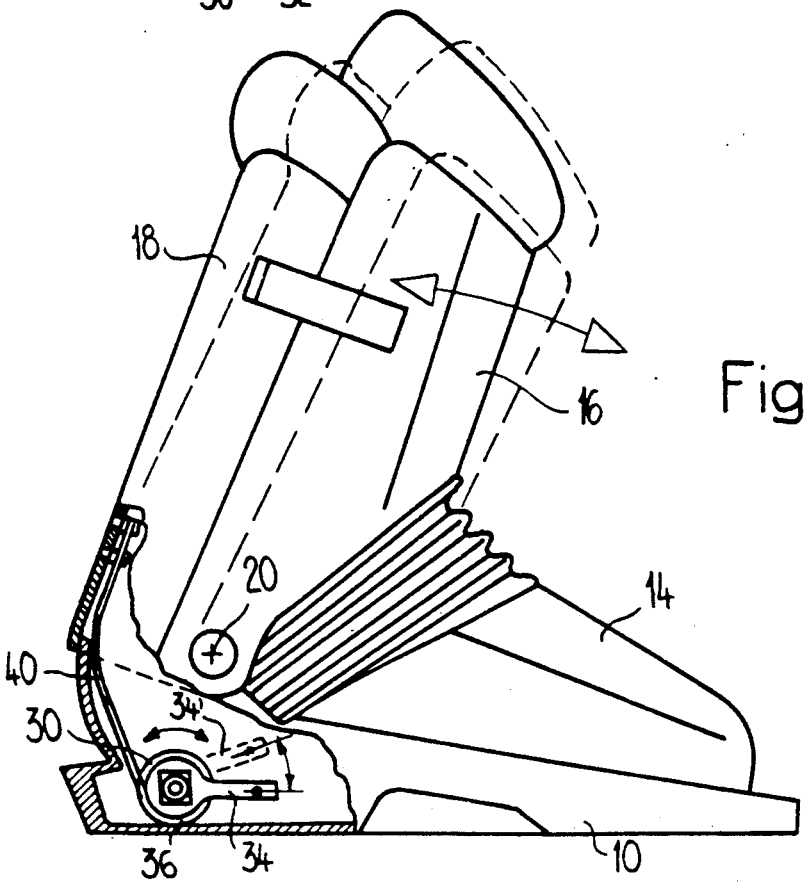
FIG. 7 shows an alternative embodiment with a possibility for adjustment for adjusting the rest position or the starting point of the spring effect.

FIG. 7 shows an embodiment which corresponds essentially to that according to FIG. 1 but in which, however, the spring element 30, on its rotation protection bracket 34, can be adjusted within a limited angle. The possibility for adjustment is indicated by 34'. By means of the possibility for adjustment, the rest position or the starting point of the spring effect can be adjusted, in order to be able to adapt the ski boot to the requirements of the skier.

In an embodiment according to FIGS. 8 and 9, of which FIG. 9 shows only the spring element 30 and the force transmission members, the spring element 30 is over-mounted in the longitudinal direction of the boot. Four cables 72, 74, 76 and 78 serve as force transmission members, each of which is anchored at its one end on the spring element 30 and at its other end on the front shaft part 16 at engagement points 72', 74', 76', 78'. In principle, it is also possible to arrange only the two cables 72 and 74 which, when seen in the longitudinal direction of the boot, engage behind the articulation axis 20 on the front shaft part 16. On the spring element 30, the one cable 72 is connected via a lever 80 to the core piece 32 of the spring element 30, while the other cable 74 is fastened to the outer casing of the tubular piece 36 of the spring element 30 and at the same time partially winds round the spring element. If the shaft of the ski boot is then stressed in the forward lean direction 82 by the skier, the cables 72 and 74 are tautened so that the core piece 32 rotates in one direction and the tubular piece 36 in the opposite direction.

If the cables 76 and 78 are then also arranged between the spring element 30 and the front shaft part 16, these carry out an opposite movement to the cables 72 and 74, as they are fastened onto the spring element 30 crosswise to the first-mentioned cables 72 and 74 and additionally engage on the front shaft part 16 in front of the articulation axis 20. The crosswise arrangement between the rear cables 72 and 74 and the front cables 76 and 78 is achieved by means of the right cable 72 of the rear cables being connected via the lever 80 to the core piece 32, while the left cable 78 of the front cables is connected via a further lever 84 to the same core piece 32. The arrows 86 shown in broken lines indicate the excursion direction upon a forward lean movement.

The difference between an arrangement with two cables and an arrangement with four cables is that the spring effect with two cables only exists in the forward lean direction, while with an arrangement with four cables the same spring element 30 exerts its spring force in the backward lean direction also. Over-mounting of the spring element 30 means that both the outer tubular piece 36 and the inner core piece 32 are movable relative to one another without an anchor point on a fixed part of the ski boot.

Figure 11:
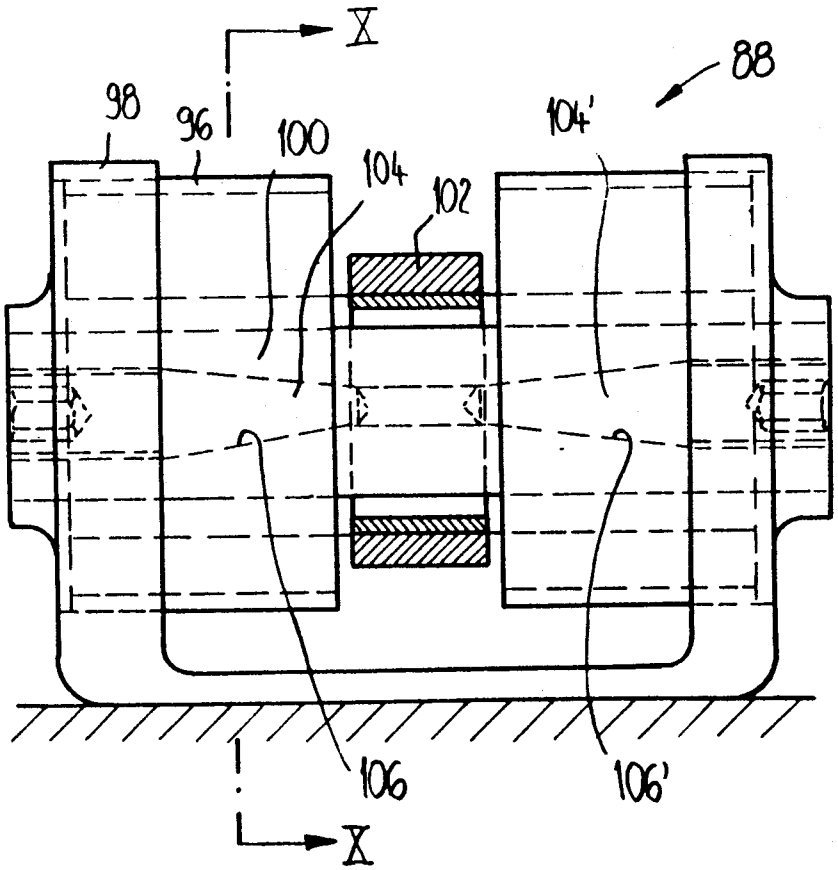
FIG. 11 shows a side view of the spring element according to FIG. 10.
Figure 10:
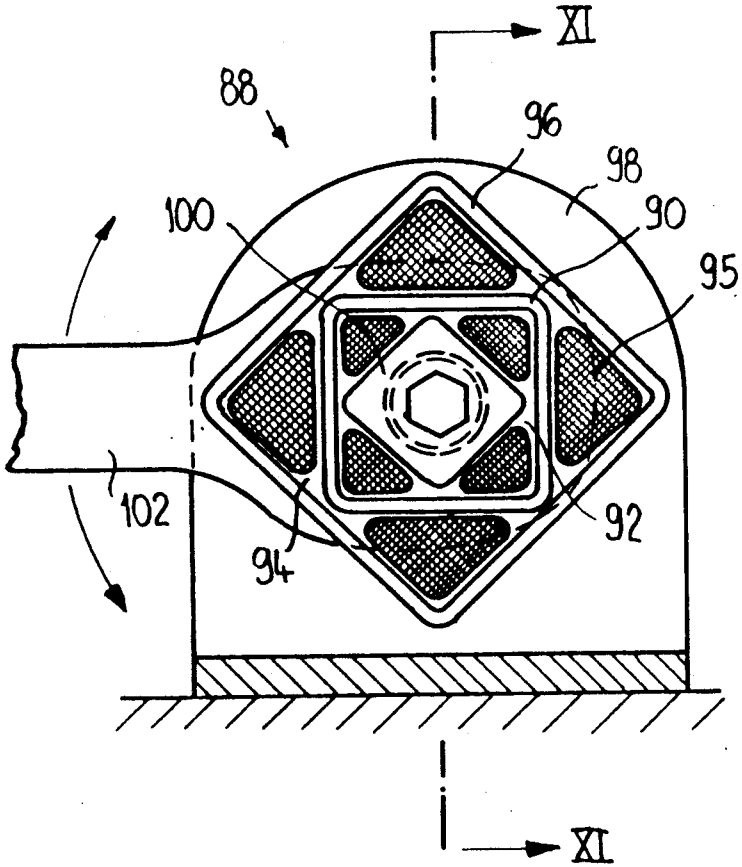
FIG. 10 shows a cross-section of a double spring element connected in parallel.

In an embodiment of a spring element 88 according to FIGS. 10 and 11, two spring elements interlock coaxially according to the principle explained with regard to FIG. 2. The outer tubular piece 90 of the inner spring element 92 forms at the same time the core piece of the outer spring element 94. In this connection, the outer cage 96 of the outer spring element 94 is fixed in a mounting 98, and the core piece 100 of the inner spring element 92 is also fixed. The outer tubular piece 90 of the inner spring element 92, which is connected in a rotationally fixed manner to a lever 102, serves as the movable part. The outer spring element 94, like the inner spring element 92, has members 95 made of an elastomeric material.

In the arrangement, which is represented in FIGS. 10 and 11 and described above, the inner spring element 92 and the outer spring element 94 are connected in parallel in terms of their effect. It is, however, also possible to connect the spring elements 92 and 94, which are arranged coaxially to one another, serially. To this end, contrary to the embodiment shown, the lever 102 would have to engage not on the outer tubular piece 90 of the inner spring element 92, but on the core piece 100 of the latter. The core piece 100 could then of course not be held fixed. The outer tubular piece 90 of the inner spring element 92 would then be free. The advantages of serial connection lie firstly in the double angle range of two coaxially arranged spring elements and also in the very smooth progression of the flexibility curve. In this case it is also possible to achieve the flexibility curve by means of modification of the volume of the core piece 100, conical screws 104, 104' arranged at both ends being screwed into conical drill holes 106, 106' to a greater or lesser extent. It is of course a prerequisite that the core pieces 100 are formed as expanding members in the same manner as in an embodiment according to FIGS. 2 and 3.

As shown in FIG. 11, the complete spring element 88 is arranged symmetrically on both sides of the lever 102.

Figure 12:
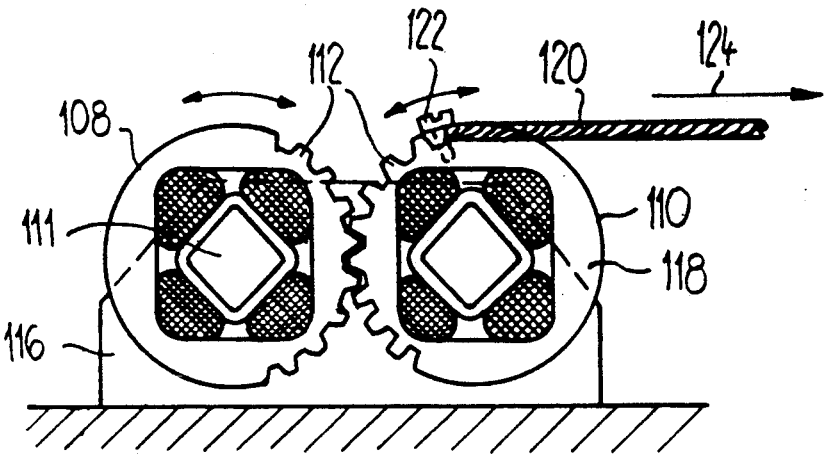
FIG. 12 shows two spring elements connected in parallel.

FIG. 12 shows an arrangement with two spring elements 108 and 110, which are arranged in parallel next to one another and which are also connected in parallel in terms of their effect. These two spring elements are provided with a serration 112 over at least a part of their circumference or they have gearwheels fitted. The serrations 112 of the two spring elements 108 and 110 engage with one another so that they must of necessity carry out an opposite movement. The core piece 111 of the spring element 108 is fixed in position by means of a mounting 116. On the outer tubular piece 118 of the second spring element 110, a tension member or tension cable 120 is fastened by means of a screw 122. Forces, which act on the tension member or tension cable 120 in the direction of the arrow 124, act in this connection uniformly on both elements, irrespective of which of the two elements is being driven. This arrangement is advantageous, with a low construction height, in order to double the forces. The arrangement can be extended as required by means of the connection of two plus one etc. elements.

Figure 13:
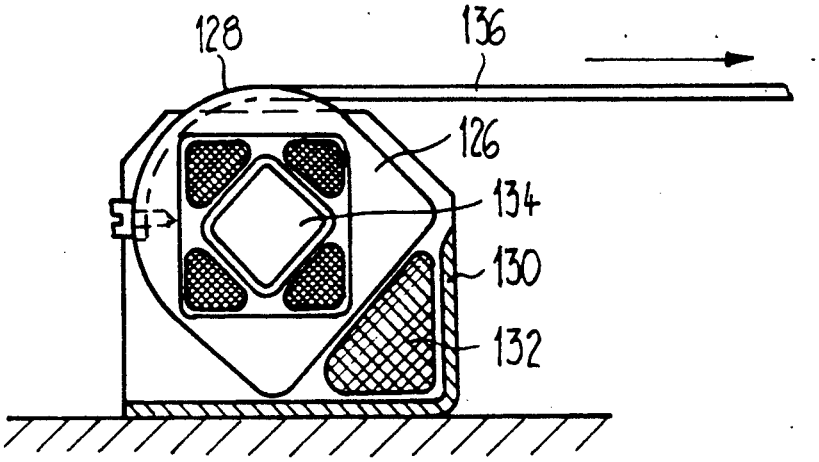
FIG. 13 shows a spring element with a rubber member connected in parallel.

In an embodiment according to FIG. 13, a further member 132 consisting of an elastomeric material is arranged between the outer tubular piece 126 of a spring element 128 and a fixed anchor point 130. The core piece 134 is likewise fixed in position. A tension member or tension cable 136 engages on the outer tubular piece 126. In the embodiment according to FIG. 13, the elastomeric member 132 is connected in parallel to the spring element. Such an embodiment can also contribute to the use of a spring element with a relatively small diameter, in order to achieve a low construction height.

What I claim is:

1. A ski boot with a boot shell which has a boot sole and is formed by a lower shell and a boot shaft which is movable relative to the lower shell at least in a forward lean direction, the ski boot comprising a damping arrangement which is effective between the lower shell and the boot shaft to resiliently dampen the forward lean movement, said damping arrangement having at least one rubber spring element comprising a core piece having a longitudinal axis, a tubular piece coaxially surrounding said core piece, one of said core piece and said tubular piece being rotatable upon the forward lean movement relative to the other of said core piece and said tubular piece, and further comprising flexible, compressible members of elastomeric material arranged radially outward of said longitudinal axis of said core piece and radially inward of said tubular piece, as to be between said core piece and said tubular piece, said compressible, flexible members being compressed by the relative rotation between said core piece and said tubular piece occurring during the forward lean movement, thus elastically limiting said relative rotation, said at least one spring element seated in said lower shell; and a force transmission member extending between at least one of said core and said tubular piece of said spring member and said boot shaft.

2. The ski boot as claimed in claim 1, wherein said rubber spring element is connected by means of one of two parts consisting of said tubular piece and said core piece in a rotationally fixed manner to one of the group consisting of the lower shell and the boot sole and the other of said two parts consisting of the tubular piece and the core piece is connected via at least one said force transmission member to the boot shaft.

3. The ski boot as claimed in claim 2, wherein the boot shaft has a front shaft part and a rear shaft part and the force transmission member has a lever which is arranged on the rubber spring element and, by means of a connecting rod, engages on one of a group consisting of the front shaft part, the rear shaft part and both the front and rear shaft parts.

4. The ski boot as claimed in claim 2, wherein boot shaft has a front shaft part and a rear shaft part and the force transmission member further comprises a lever which is arranged on the rubber spring element and, by means of an oblong hole which extends in the longitudinal direction in the lever, engages a carrier pin which is connected to an extension of the front shaft part.

5. The ski boot as claimed in claim 2, wherein the boot shaft has a front shaft part and a rear shaft part and the force transmission member is formed by tension element from the group consisting of cables and chains which wind round the rubber spring element whereby a one of two ends of said tension element are attached in an opposite manner to each one of the front and rear shaft parts.

6. The ski boot as claimed in claim 2, wherein a further rubber spring element is connected parallel to the first-mentioned rubber spring element and both rubber spring elements are arranged next to one another with parallel axes and have serrations which engage with one another mutually and in an opposite manner, the force transmission member engages on one of the rubber spring elements while the other rubber spring element is anchored on one of a group consisting of the lower shell and the boot sole.

7. The ski boot as claimed in claim 2, wherein at least one further member, which is comprised of an elastomeric material, is arranged between the tubular piece and a fixed anchor point attached to one of a group consisting of the lower shell and the boot sole, wherein the core piece is fixed in position and wherein the force transmission member is attached to the tubular piece.

8. The ski boot as claimed in claim 2, wherein the force transmission member is a tension member which engages on the rear part of the shaft.

9. The ski boot as claimed in claim 8, wherein the tension member, by means of an oblong hole, which extends in the longitudinal direction of the tension member, engages on a pin which is connected to the tubular piece of the spring element.

10. The ski boot as claimed in claim 2, wherein means to adjust a rest position of the spring effect are arranged in the force transmission path between one of a group consisting of the lower shell and the boot sole and the boot shaft.

11. The ski boot as claimed in claim 10, wherein the boot shaft has a front shaft part and a rear shaft part and the means to adjust the rest position of the spring effect further comprises a longitudinal adjustment element, in particular a threaded bolt which is fastened to a tension member and a nut which can be adjusted through a window in the rear shaft part.

12. The ski boot as claimed in claim 10, wherein the means to adjust the rest position of the spring effect have an adjustment element for the fastening of the spring element between one of the group consisting of the lower shell and the boot sole and the one of the two parts consisting of the tubular piece and the core piece of the spring element which is to be connected to one of a group consisting of the lower shell and the boot sole in a rotationally fixed manner.

13. The ski boot as claimed in claim 2, wherein the rubber spring element is arranged in the sole area, in particular in the heel area.

14. The ski boot as claimed in claim 1, wherein said rubber spring element is connected with one of its two parts consisting of said tubular piece and said core piece to the boot shaft and wherein the other of said two parts consisting of said tubular piece and said core piece is connected via at least one force transmission member to one of a group consisting of the lower shell and the boot sole.

15. The ski boot as claimed in claim 1 further comprising means for adjusting the prestress of the rubber spring element.

16. The ski boot as claimed in claim 15, wherein the core piece is formed as a hollow expanding member and wherein the means of adjusting the prestress comprises a cone, which resiliently expands the expanding member and is preferably adjustable by means of a screw which is accessible from outside the boot.

17. The ski boot as claimed in claim 1, wherein the rubber spring element is over-mounted and clamped on the shaft via two force transmission members in the form of tension elements, between two engagement points arranged behind an articulation axis of the boot shaft, said axis lies transversely to the longitudinal axis of the boot.

18. The ski boot as claimed in claim 17, wherein the rubber spring element is mounted in the longitudinal axis of the boot and the two tension elements engage on the end of the rubber spring element which faces towards the rear, while the rubber spring element, at its end facing towards the front, is clamped, in an opposite manner to its end facing towards the rear, via two further tension elements between two engagement points arranged in front of the articulation axis.

19. The ski boot as claimed in claim 1, wherein the rubber spring element has, arranged between the tubular piece and a second tubular piece which surrounds the tubular piece coaxially, further members comprised of an elastomeric material that makes possible a limited relative rotation between the two tubular pieces.

20. The ski boot as claimed in claim 19, wherein the core piece and one of a group consisting of the tubular piece and the second tubular piece are clamped in a rotationally fixed manner and wherein the force transmission member engages one of the group consisting of the tubular piece and a sub-group consisting of the core piece (100) and the second tubular piece.

21. The ski boot as claimed in claim 19, wherein the core piece is clamped in a rotationally fixed manner and the force transmission member engages the second tubular piece.

22. The ski boot as claimed in claim 19, wherein the second tubular piece is clamped in a rotationally fixed manner and the core piece engages the force transmission member.

* * * * *

US005088211A

REEXAMINATION CERTIFICATE (2297th)

United States Patent [19]

Walkhoff

[11] B1 5,088,211

[45] Certificate Issued May 10, 1994

[54] SKI BOOT

[75] Inventor: Klaus Walkhoff, Kreuzlingen, Switzerland

[73] Assignee: Raichle Sportschuh AG, Kreuzlingen, Switzerland

Reexamination Request:
No. 90/003,090, Jun. 8, 1993

Reexamination Certificate for:

| | |
|---|---|
| Patent No.: | **5,088,211** |
| Issued: | **Feb. 18, 1992** |
| Appl. No.: | **427,495** |
| Filed: | **Oct. 27, 1989** |

[30] Foreign Application Priority Data

Nov. 21, 1988 [CH] Switzerland ..... 4308/88

[51] Int. Cl.[5] ..... A43B 5/04

[52] U.S. Cl. ..... 36/117; 36/119; 36/120

[58] Field of Search ..... 36/117, 118, 119, 120, 36/121

[56] References Cited

U.S. PATENT DOCUMENTS

| | | | |
|---|---|---|---|
| 3,686,778 | 8/1972 | Hornung | 36/120 |
| 3,696,534 | 10/1972 | Hornung | 36/121 |
| 3,735,508 | 5/1973 | Gertsch et al. | 36/121 |
| 4,085,528 | 4/1978 | Delery | 36/121 |
| 4,455,769 | 6/1984 | Fritsch | 36/121 |
| 4,611,414 | 9/1986 | Vogel | 36/120 |

FOREIGN PATENT DOCUMENTS

| | | |
|---|---|---|
| 411555 | 6/1969 | Australia . |
| 957495 | 2/1950 | France . |
| 51-137075 | 11/1976 | Japan . |
| 423367 | 4/1967 | Switzerland . |

*Primary Examiner*—Paul T. Sewell

[57] ABSTRACT

In the heel area of a ski boot a rubber torsion spring element is arranged, the core piece of which is anchored in a rotationally fixed manner on the lower shell of the ski boot by means of a bracket. An outer tubular piece, which surrounds the core piece coaxially, is connected to a tension member which engages with its end at the rear on a rear shaft part of the boot shell. The rear shaft part and a front shaft part are pivotable relative to the lower shell about an articulation axis into a forward lean position. The spring element damps the forward lean movement and, by means of the use of snappy rubber compounds, is extensively independent of the ambient temperature. Additionally, it allows the adjustment at least of the starting point of the spring or damping effect by means of a knurled nut.

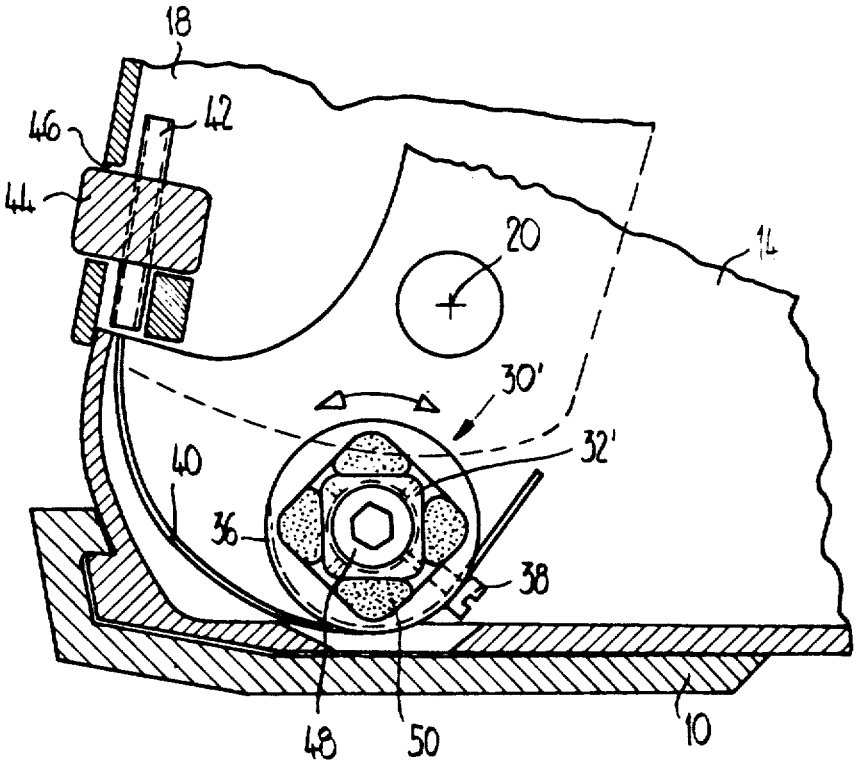

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 46–63:

By means of the special formation of the rubber spring element, not only a progressive spring characteristic but also a limiting of the spring excursion by the spring element itself is achieved. This has the special [advantage that a hard and unpleasant stop to special] advantage that a hard and unpleasant stop to limit the spring excursion is not necessary. The damping effect is created by means of a rotation and flexing movement of the elastomeric members upon a relative rotation between core piece and tubular piece. For the rubber elements, materials can be used which have already proved reliable for similar uses, preferably materials based on natural rubber or synthetic elastomers. In particular by means of the use of snappy rubber compounds, such a spring element is not subject to any significant temperature influences within the field of use, so that a constant spring effect is to be expected.

Column 2, lines 4–28:

In a preferred embodiment according to claim [3] *13*, the rubber spring element is accommodated in a particularly protected location, so that a risk of accident or damage is completely excluded, in particular when the spring element is accommodated completely within the heel. Additionally, with such an accommodation, the risk of dirtying is also relatively low. In the embodiment according to claim [5] *15*, the spring characteristic can be adjusted, so that a ski boot equipped with such an element can be adapted to the abilities of the skier.

An especially preferred embodiment is produced according to claim [6] *16*, by means of which embodiment the spring characteristic can be adjusted by the skier himself with simple and easily accessible means. In spite of this individual possibility for adjustment of the flexing effect by changing the prestress, there is no limitation of the angle of rotation and thus of the spring excursion.

By means of a preferred embodiment according to claim [7] *10*, that position of the shaft relative to the boot sole or to the lower shell can be selected in which the spring effect is equal to zero. Starting from this "zero position", a spring effect is possible in both the forward lean and backward lean direction and is dependent on the arrangement of the force transmission member.

Column 2, line 33—column 3, line 18:

Claim [9] *11* describes a preferred embodiment for adjusting the rest position or the starting point of the spring effect in connection with claim 8. The nut which is used for the adjustment can be a knurled nut, for example, so that the adjustment can be carried out at the rear on the shaft at any time and without tools by the skier himself.

Claim [10] *12* describes a possibility for adjusting the rest position or the starting point of the spring effect, when the force transmission member engages on the shaft without any possibility for adjustment. In the embodiment according to claim [10] *12*, the adjustment is generally carried out by means of a tool, so that such an embodiment is advantageous if an inadvertent readjustment is to be avoided.

In an embodiment according to claim [11] *9*, the spring effect is limited to a movement in the forward lean direction, although the rear shaft part can be swung up, without stress on the spring element, for insertion of the foot.

In an embodiment according to claim [14] *5*, there is a rigid connection in both directions between the spring element and the shaft, so that the spring effect of the spring element is stressed in both the forward lean and backward lean direction.

In an embodiment according to claim [13] *4*, similarly to that according to claim [12] *3*, there is a spring effect on the shaft in both directions but, by means of the different geometry of the force transmission elements, a different distribution of the spring characteristic on the pivoting angle of the shaft is brought about.

Claim [14] *5* describes an embodiment, in which additionally a double-sided effect of the spring element is transmitted to the shaft by means of cables or chains.

In an embodiment according to claim [15] *17*, the spring effect is only transmitted in the forward lean [directions] *direction*, while in an embodiment according to claim [16] *18* the spring effect is transmitted in both the forward lean and backward lean [direction] *directions*. For the specialist it is clear that the cables, starting from the spring element, must first run parallel to the sole surface, in order that they can then be guided, via deflection elements, along the inner wall to the points of engagement on the shaft.

In an embodiment according to claim [17] *19*, two spring elements interlock. These can be arranged in terms of their effect either in parallel according to claim [18] *20* or serially according to claim [19] *21*. By means of these possibilities, the specialist is afforded the opportunity of selecting the arrangement depending upon the desired spring effect.

An arrangement according to claim [20] *6* is particularly advantageous when a low construction height is to be achieved.

Claim [21] *7* demonstrates a possibility for supplementing the characteristic of a spring element.

AS A RESULT OF REEXAMINATION, IT HAS BEEN DETERMINED THAT:

Claims 1, 4, 8 and 20 are determined to be patentable as amended.

Claims 2, 3, 5, 6, 7, 9-19, 21 and 22, dependent on an amended claim, are determined to be patentable.

1. A ski boot with a boot shell which has a boot sole and is formed by a lower shell and a boot shaft which is movable relative to the lower shell at least in a forward lean direction, the ski boot comprising a damping arrangement which is effective between the lower shell and the boot shaft to resiliently dampen the forward lean movement, said damping arrangement having at least one rubber spring element comprising a core piece having a longitudinal axis, a tubular piece coaxially surrounding said core piece, one of said core piece and said tubular piece being rotatable upon the forward lean movement relative to the other of said core piece and said tubular piece, and further comprising flexible, compressible members of elastomeric material arranged radially outward of said longitudinal axis of said core piece and radially inward of said tubular piece, as to be between said core piece and said tubular piece, said compressible, flexible members being compressed by the relative rotation between said core piece and said tubular piece occurring during the forward lean movement, thus elastically limiting said relative rotation, said at least one spring element seated in said lower shell; and a force transmission member extending between at least one of said core and said tubular piece of said *rubber* spring [member] *element* and said boot shaft.

4. The ski boot as claimed in claim 2, wherein *the* boot shaft has a front shaft part and a rear shaft part and the force transmission member further comprises a lever which is arranged on the rubber spring element and, by means of an oblong hole which extends in the longtitudinal direction in the lever, engages a carrier pin which is connected to an extension of the front shaft part.

8. The ski boot as claimed in claim 2, wherein the force transmission member is a tension member which engages on the rear part of the *boot* shaft.

20. The ski boot as claimed in claim 19, wherein the core piece and one of a group consisting of the tubular piece and the second tubular piece are clamped in a rotationally fixed manner and wherein the force transmission member engages one of the group consisting of the tubular piece and a sub-group consisting of the core piece [(100)] and the second tubular piece.

* * * * *